United States Patent [19]

Pate

[11] 4,125,972

[45] Nov. 21, 1978

[54] MONOCOQUE CELL

[76] Inventor: Paul E. Pate, 3319 Dartmouth, Dallas, Tex. 75205

[21] Appl. No.: 862,097

[22] Filed: Dec. 19, 1977

Related U.S. Application Data

[63] Continuation of Ser. No. 721,510, Sep. 8, 1976, abandoned.

[51] Int. Cl.[2] ..... E04H 1/12; E04B 7/02; E04B 5/48

[52] U.S. Cl. ..... 52/79.12; 52/90; 52/221; 52/282; 52/284; 52/309.9; 52/586; 52/59 S

[58] Field of Search ..... 52/90, 79.12, 79.1, 52/221, 282, 309.14, 309.9, 595, 622, 629, 284, 286, 593, 586

[56] References Cited

U.S. PATENT DOCUMENTS

| | | | |
|---|---|---|---|
| Re. 28,367 | 3/1975 | Rich, Jr. et al. | 52/79.8 X |
| 2,129,441 | 9/1938 | Otto | 52/90 |
| 2,361,733 | 10/1944 | Bartholomew | 52/622 X |
| 2,489,670 | 11/1949 | Powell, Jr. | 52/282 |
| 2,877,508 | 3/1959 | Ewart | 52/125 |
| 3,236,014 | 2/1966 | Edgar | 52/286 X |
| 3,462,897 | 8/1969 | Weinrott | 52/90 X |
| 3,665,662 | 5/1972 | Timbrook et al. | 52/90 X |
| 3,683,569 | 8/1972 | Holm | 52/622 |
| 3,712,004 | 1/1973 | Loebsack | 52/586 X |
| 3,716,259 | 2/1973 | Weill et al. | 52/627 |
| 3,760,547 | 9/1973 | Brenneman | 52/586 |
| 3,866,381 | 2/1975 | Eschbach et al. | 52/282 |
| 3,942,290 | 3/1976 | O'Sheeran | 52/90 X |

FOREIGN PATENT DOCUMENTS

| | | | |
|---|---|---|---|
| 190,934 | 8/1937 | Switzerland | 52/282 |
| 993,628 | 6/1965 | United Kingdom | 52/629 |

*Primary Examiner*—Leslie Braun
*Attorney, Agent, or Firm*—Richards, Harris & Medlock

[57] ABSTRACT

The specification discloses a building system comprising a plurality of modular elements, each having interlockable edges around the entire periphery thereof. These elements are interlockable, one to the other, to form a completed housing structure. The elements include flat side wall members having an interlockable edge around the entire periphery and curved wall joint members having a cross sectional width wider than the thickness of the joint members such that the longitudinal edges of the wall joint members are moved from the immediate corner thereof. Each curved wall joint member has an interlockable edge around its entire perimeter which interconnects with the interlockable edge of the side members such that an enclosed structure can be formed by selective interconnecting the side members and the curved wall joint members. The roof and flooring are added by the use of flat roof and floor members, each having an interlockable edge around the entire perimeter thereof, curved roof to wall joint members having an interlockable edge around the entire edge perimeter and curved floor to wall joint members having an interlockable edge around their entire perimeter for interconnecting with the edge of the side wall members to connect the roof and floor members to the wall members. The structure is further characterized by curved corner members having interlockable edges around their entire edge boundary for interconnection with the interlocking edges of the end of the curved wall joint members and the roof to wall joint members to form a sealed structure. Both the roof and floor to wall joint members and the curved corner members have an overall cross-sectional width wider than the thickness of the wall of the member such that the edges of these members are removed from the center thereof.

12 Claims, 15 Drawing Figures

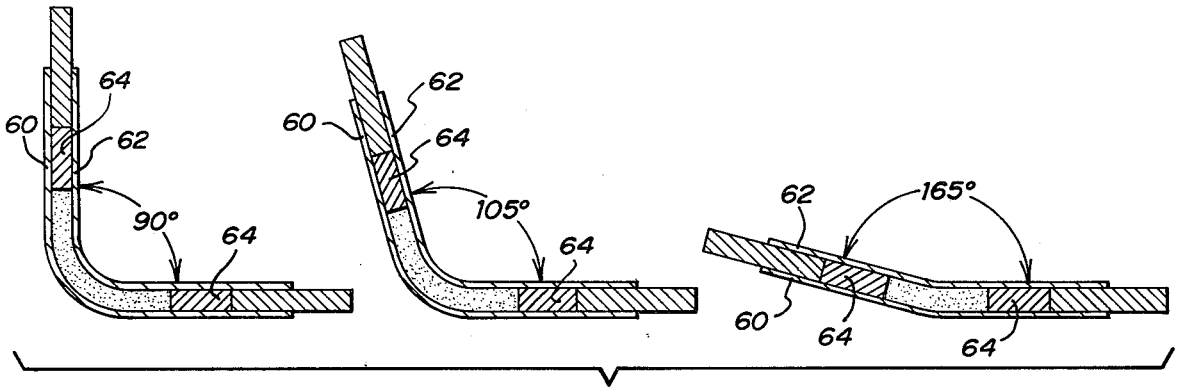
FIG. 7
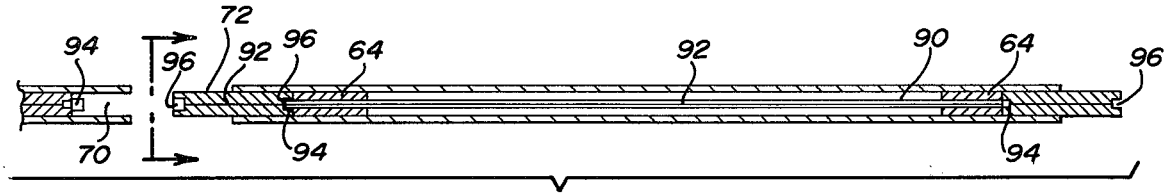
FIG. 12
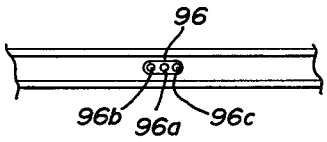
FIG. 13
FIG. 10
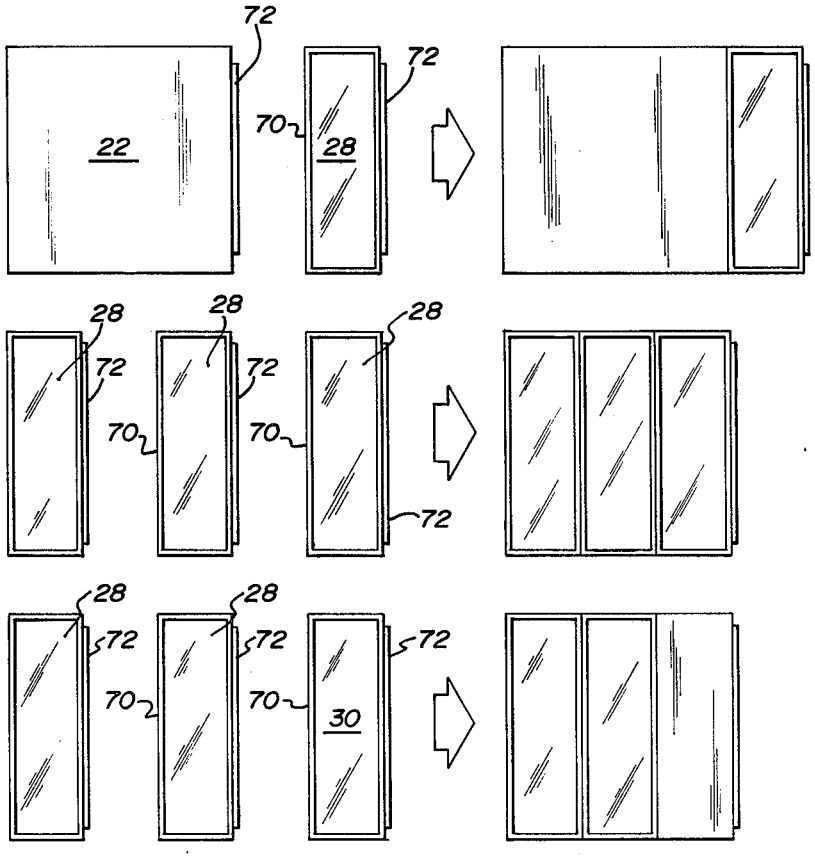

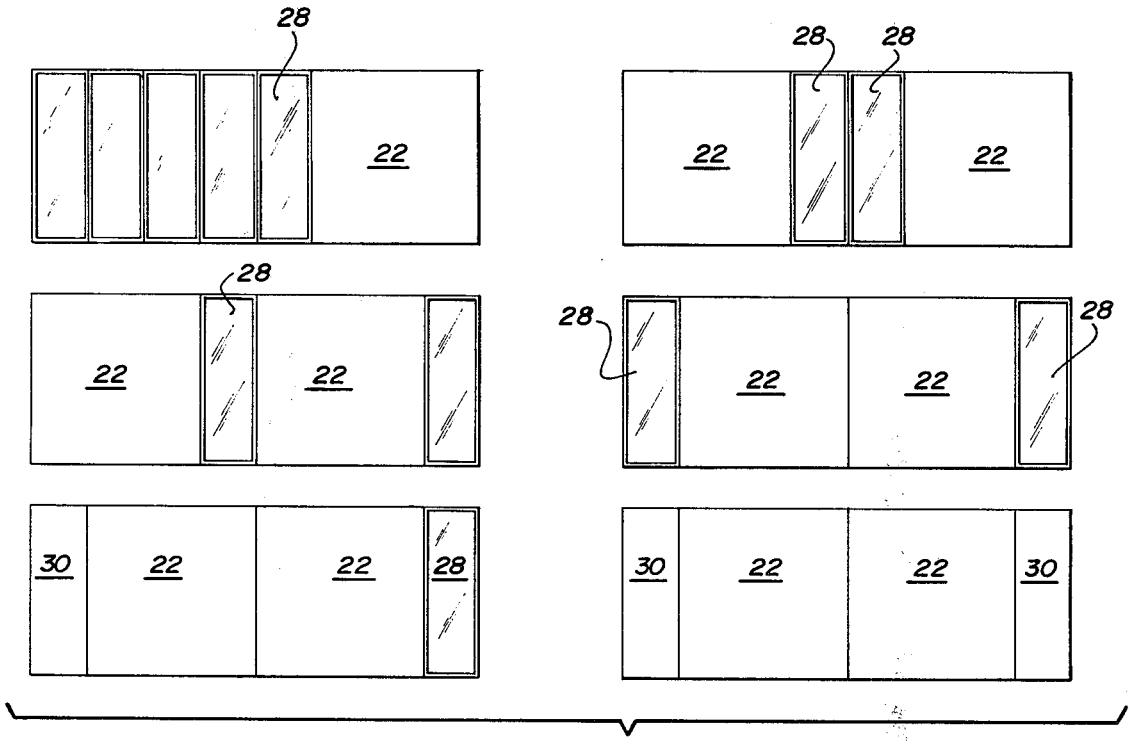
FIG. 11
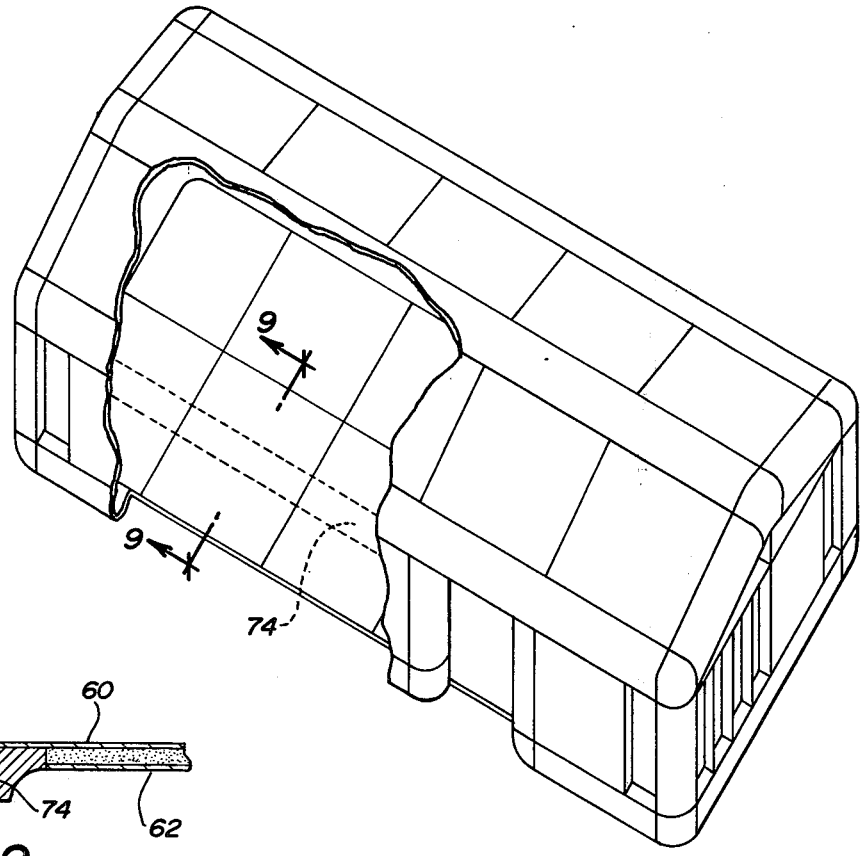
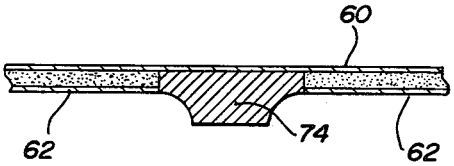
FIG. 9
FIG. 8

MONOCOQUE CELL

This is a continuation of application Ser. No. 721,510, filed Sept. 8, 1976, now abandoned.

BACKGROUND OF THE INVENTION

1. Field of the Invention

The present invention relates to building structures and more particularly to modular building structures wherein each joint is a butt type joint.

2. Prior Art

Millions of additional living units are needed each year in the United States as well as in foreign countries. At present, a substantial portion of these needs are met by conventional housing structures while many of the needs go unfulfilled because of the high cost of these conventional units. Research and development has produced few total systems to adequately resolve the housing needs both in this and in foreign countries as present structures fail to provide adequate housing at a cost affordable to every individual and family. While some new concepts have been introduced into the construction of conventional housing units to reduce material and labor costs involved in constructing these units, the effect of such changes to produce low cost structurally sound homes has been insufficient in providing suitable housing affordable by lower income groups.

Modular structures have also been proposed as an alternative to conventional structures but their use has generally been restricted to the production of smaller utility and other than primary housing structures. At present the modular structures have failed to provide structurally sound, low cost, aesthetic structures which provide modern conveniences and comforts.

SUMMARY OF THE INVENTION

The present invention discloses a building system responsive to the need for low cost housing while providing the options of size, configuration and economy in concert with aesthetic requirements and needs. In accordance with one embodiment of the invention, the building structure comprises a plurality of modular elements, each having interlockable edges around the entire periphery thereof. These elements are interlockable, one to the other, to form a completed housing structure. The elements include flat side wall members having an interlockable edge around the entire periphery and curved wall joint members having a cross sectional width wider than the thickness of the joint members such that the longitudinal edges of the wall joint members are moved from the immediate corner thereof. Each curved wall joint member has an interlockable edge around its entire perimeter which interconnects with the interlockable edge of the side members such that an enclosed structure can be formed by selective interconnecting the side members and the curved wall joint members.

The roof is added by the use of flat roof members, also having an interlockable edge around the entire perimeter thereof, curved roof to wall joint members having an interlockable edge around the entire edge perimeter for interconnecting with the edge of the side wall members and the roof members to connect the roof to the wall members. The structure is further characterized by curved corner members having interlockable edges around their entire edge boundary for interconnection with the interlocking edges of the end of the curved wall joint members and the roof to wall joint members to form a sealed structure. Both the roof to wall joint members and the curved corner members have an overall cross-sectional width wider than the thickness of the wall of the member such that the edges of these members are removed from the center thereof. In this way, the joint between these members is removed from the maximum stress areas which occur at the corner-most point between the walls and the roof.

Similarly, the flooring includes flat floor members having an interlockable edge around the entire perimeter thereof and are joined to the wall members by curved floor to wall joint members having an interlockable edge around their perimeter for interconnection between the floor members and the side wall members. The curved floor to wall joint members have a cross-sectional width wider than the thickness thereof such that the longitudinal edge of the floor to wall joint members are removed from the corner-most point thereof.

In one embodiment of the invention, the interlockable edges of the structural elements are characterized by a continuous projection or by a corresponding receiving groove adapted for receiving the projection from an adjacent member. In this embodiment, the connection between each element forms a tongue and groove butt-type interlock.

In accordance with another embodiment of the invention, the side wall members, flat roof members, and floor members are similarly sized so that they are interchangeable one with the other. Moreover, corner members are identical one to the other and therefore are interchangeable. Likewise, floor to wall corner members and roof to wall joint members are identical one to the other and are interchangeable. The invention is further characterized by window units which are substitutable for the wall and roof panels thereby permitting the introduction of windows into the structure at desired locations. Similarly, door units may be inserted as desired around the housing structure to form the door openings.

In accordance with another embodiment of the invention, the housing structure may be further customized through gabling the roof structure by introducing triangular gable panels between the wall members and the curved wall to roof joint members and by introducing an appropriately curved roof to roof joint member between the roof panels at the apex of the roof structure.

In accordance with still another more detailed aspect of the invention, the wall panels are formed with a prefinished skin attached over an insulating core. Electrical systems are impregnated within the panels and corner members which are provided with connectors such that the electrical circuitry is completed by merely interconnecting the components in constructing the structure.

Thus, the present invention is directed to a housing structure composed of prefabricated and prefinished components which may be easily assembled to form an intergrated structurally sound structure. The entire structure is constructed with butt-type joints only, using, in one embodiment, a tongue and groove interlock design. The system is further composed of a minimum number of components which easily allow for expansion and customizing of the structure as desired. While the structure of the present invention has been described with respect to housing, it will be apparent to one skilled in the art that the concepts are readily adaptable to the formation of any building structure regardless of its intended purpose or use.

DESCRIPTION OF THE DRAWINGS

For a more complete understanding of the present invention, and for further details and advantages thereof, reference is now made to the following description taken in conjunction with the accompanying drawings, in which:

FIG. 7 illustrates the angle variation achievable as required in the present invention;

FIG. 8 is a partially broken away perspective view of the structure of the present invention showing the floor members;

FIG. 9 is a section of the floor member taken along line 9—9 of FIG. 8;

FIG. 10 illustrates the alternative arrangements of panels which may be interchanged to customize the structure of the present invention;

FIG. 11 further illustrates alternative arrangements of wall and window panels to customize the structure of the present invention;

FIG. 12 shows a panel of the present invention with the electrical system impregnated therein; and FIG. 13 is a view taken along line 13—13 of FIG. 12 showing the electrical connection between adjacent panels.

DESCRIPTION OF THE PREFERRED EMBODIMENTS

Figure 1:
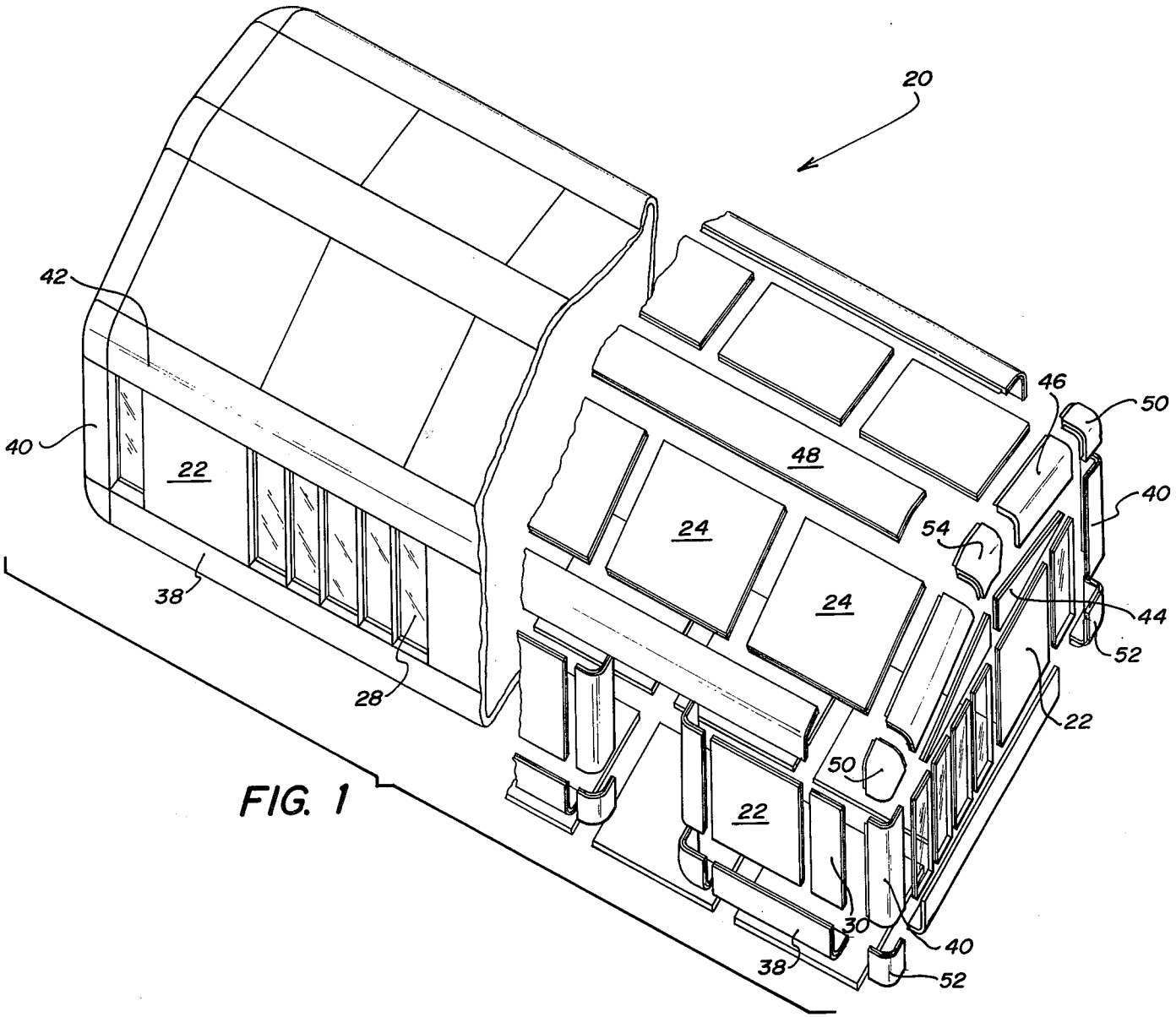
FIG. 1 is a perspective view of a completed structure according to the present invention with a portion of the structure exploded to show the individual elements making up the assembled structure.

Referring to FIG. 1, there is illustrated in perspective view the modular structure 20 of the present invention. The right hand portion of FIG. 1 is an exploded perspective view showing the individual elements comprised in structure 20. Structure 20 includes several flat and dimensionally square members including side wall members 22, roof members 24 and floor members 26. In one embodiment of the invention, the side wall, roof and floor members are dimensionally identical such that one unit may be used at all three application points. Window units 28 are freely substitutable for side members 22, as are smaller wall panels 30. Normally, the height dimension of window units 28 and smaller wall panels 30 are equal to the height dimension of wall members 22, though somewhat narrower than wall members 22. The window units 28 and smaller wall panels 30 are so dimensioned along their width such that an equal number of these units may be substituted for a single side wall member 22. For example, in one embodiment of the invention, wall members 22 are 6 × 6 feet square while window units and wall panels are 6 feet high by 2 feet wide. Thus, three window units may be interchanged with a wall unit 22 without altering the geometry of the structure being constructed. Wall members 22 are interconnected to floor members 26 by curved floor to wall joint members 38 and to adjacent wall or window units by curved wall joint members 40. Wall members 22, window units 28 and wall panels 30 are interconnected to roof members 24 by wall to roof joint members 42.

In the embodiment illustrated in FIG. 1, the roof of the structure is gabled by the use of gable panels 44 between the wall members and the roof members 24. In this embodiment, gable panels 44 are interconnected to roof members 24 by roof to gable joint members 46. Where the gable design is used, roof members 24 are connected at the ridge of the roof by curved ridge member 48. Wall joint 40, wall to roof joint member 42 and roof to gable joint member 46 are interconnected at their adjacent ends by corner member 50. Similarly, wall joint member 40 and wall to floor joint members 38 are interconnected at their adjacent ends by lower corner member 52, and roof to gable joint member 46 and ridge member 48 are interconnected at their adjacent ends by ridge corner member 54. In this way, a totally enclosed and unified structure is completed by the interconnection of the members heretofore described. FIG. 1 further illustrates the use of wall joint members 40 and lower corner members 52 to provide a door access into the structural enclosure.

One structure for joining the heretofore described component members is illustrated in detail in FIGS. 2 through 6. In a primary embodiment of the invention the joint is a tongue and groove connection which permits all joints between adjacent panels to be butt-type joints thereby eliminating conventional angle joints. This feature is permitted by the use of the curved joint members 38, 40, 42, 46, and corner members 50 and 52.

Figure 5:
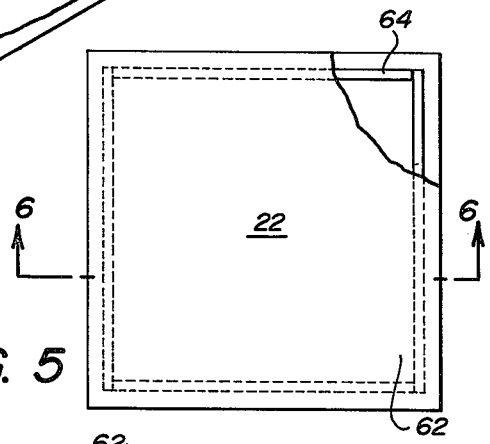
FIG. 5 illustrates one of the panels of the present invention with the outer skin partially broken away.
Figure 6:
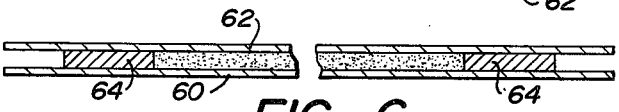
FIG. 6 is a section view taken along line 6—6 of FIG. 5.
Figure 3A:
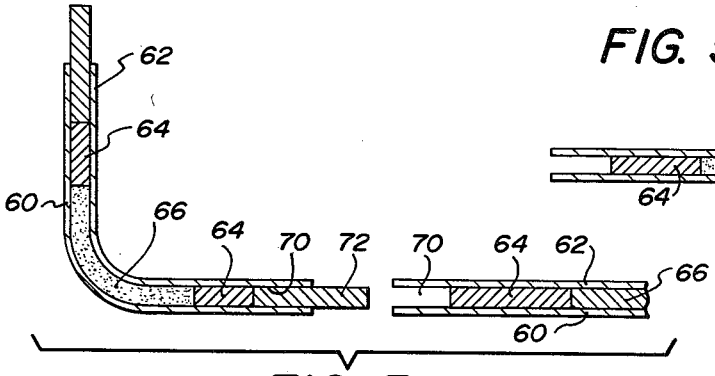
FIG. 3*a* is a section view taken along line 3—3 of FIG. 2.
Figure 4:
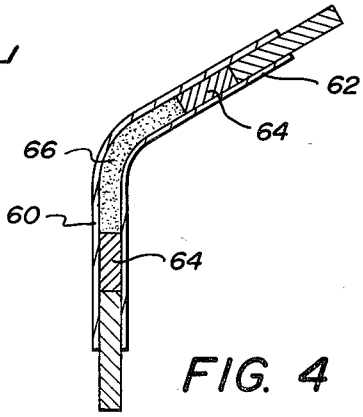
FIG. 4 is a section view taken along line 4—4 in FIG. 2.

FIGS. 3*a* and 4, section views taken through corner member 50 and joint member 46, illustrate the typical construction of these elements for one embodiment of the invention. Likewise, FIG. 6, a section view of wall member 22 illustrated in FIG. 5, shows a typical construction of the flat wall members. As is illustrated, these members are composed of outer and inner structural skins 60 and 62 respectively, which are maintained in a spaced apart relationship by separating strips 64 and have an insulating core 66 sandwiched therebetween. The outer and inner skin 60 and 62 may be of any suitable material such as plywood or other selected hard or soft woods, depending upon the strength and appearance desired, as well as upon the cost factors associated with the use of differing woods. The insulating core 66 may likewise be of any suitable composition such as fiberglass or foam insulation. As can be seen in FIGS. 3*a*, 5 and 6, strips 64 extend substantially around the entire perimeter of the inner and outer skins although spaced somewhat inwardly from the edges thereof to form a groove 70 about the entire perimeter edge of the panel. Thus, even where no insulating core 66 is provided between the inner and outer skins, the air entrapped therein will serve as an insulation. While it is invisioned that it will be more advantageous and aesthetically pleasing to use wood and wood by-products for many of the components herein described, these components may in total, or in part, be composed of synthetic material such as plastic or of aluminum or fiberglass. Moreover, while the thickness of the panels will be determined by the particular application of the structure, wall thicknesses of 3 inches are envisioned with greater or lesser thicknesses being easily adaptable to the present invention.

As may be seen in FIG. 7, the outer and inner skins 60 and 62 may be contoured to any desired radius to make the necessary angles for the joint and corner members. Moreover, as is illustrated in FIGS. 8 and 9, an integral longitudinal reinforcing rib 74 may be formed on, or attached to, outer skin 60 of floor members 26 to add rigidity to the floor sections as well as to the overall complete structure.

Figure 2:
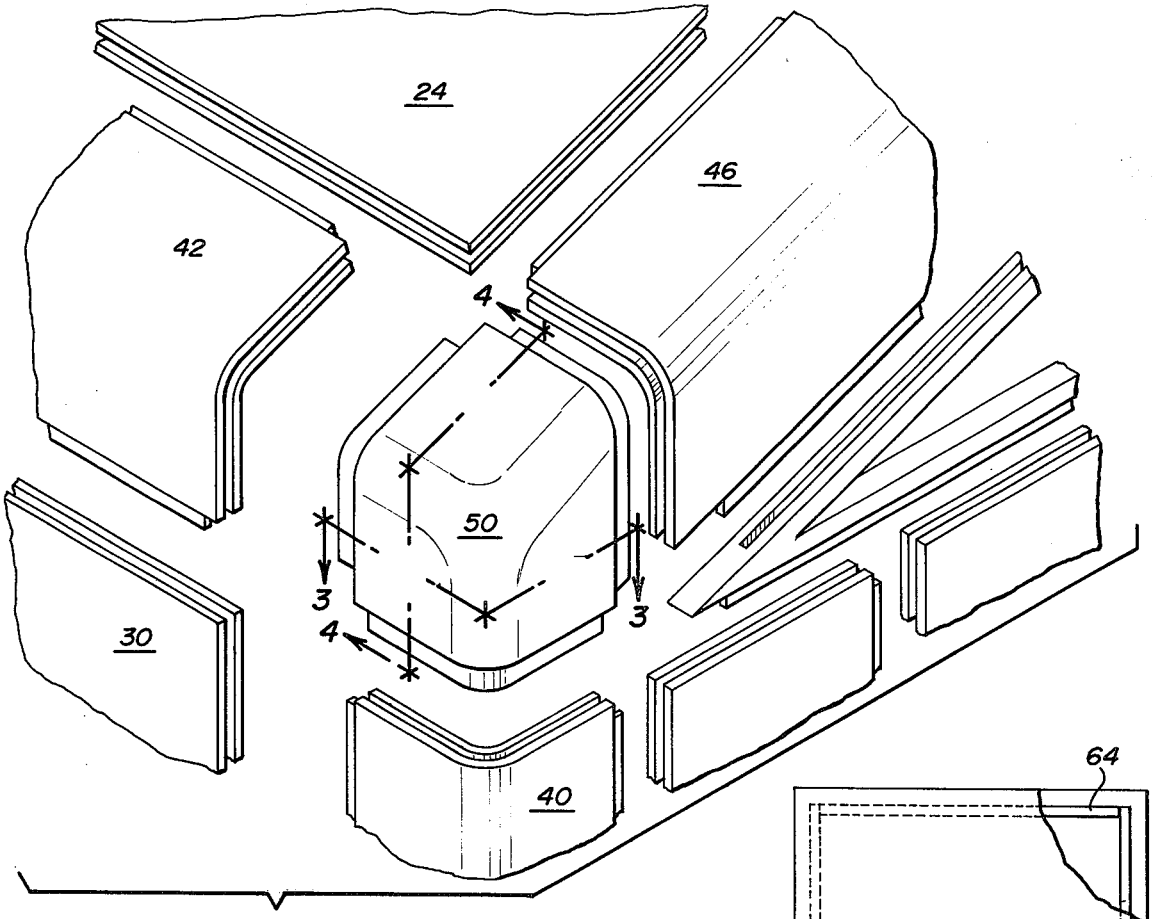
FIG. 2 is an enlarged detailed perspective view of an upper corner of the structure of the present invention.
Figure 3B:
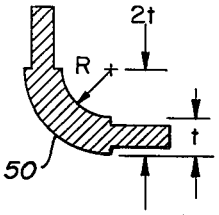
FIGS. 3*b* and 3*c* are an alternative embodiments of the corner member shown in section in FIG. 3*a;*
Figure 3C:
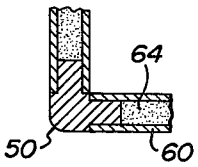

FIGS. 3*b* and 3*c* illustrate an alternative embodiments of the corner member illustrated in FIG. 2. In the embodiment shown in FIG. 3*b*, the corner member 50 is made from solid wood stock, aluminum or fiberglass having an appropriate radius as required to eliminate concentration of stresses at the corner. Where the thickness of the wall of corner member 50 is *t*, the overall width of the corner member is 2*t* as illustrated in FIG. 3*b*. Similarly, in this embodiment, the wall joint members 40, the wall to roof joint members 42 and the wall to floor members 38 may be formed from solid stock material. Likewise, the roof to gable joint member 46 may be similarly formed. It has been found that forming these members from solid stock not only increases the strength of the corner member but in certain instances reduces the overall cost. The embodiment illustrated in FIG. 3*c* is likewise made from solid wood stocks, aluminum or fiberglass with the tongue portion formed integrally with the corner member.

At each joint, a tongue 72 is adapted to be fitted within groove 70 formed by outer and inner skins 60 and 62. The tongue may be fitted at the time of assembly or prior to the assembly of the various members. In either event, a suitable adhesive, such as an epoxy paint, is applied to tongue 72 which is thereafter fitted within groove 70. The groove 70 along the edge of the corresponding member is left vacant to accept the protruding portion of tongue 72 extending from groove 70 of the adjacent member. As may be seen in FIG. 2, at each joint there is a portion of tongue 72 extending from one component member and a groove 70 in the adjacent member ready to accept the protruding portion of tongue 72 in the member to which it is to be attached. In assembly of the components, an adhesive is applied to the protruding portion of tongue 72 and the tongue is engaged within groove 70 of the adjacent member. In this way, the floor panels, wall and roof panels and gable panels are all interconnected by the associated joint and corner members to complete a monolithic structure.

As is illustrated in FIG. 10, the wall of the structure is built up by assembling wall members 22, window units 28 and smaller wall panels 30 by inserting the protrusion of tongue 72 into the corresponding groove 70 of the edge of an adjacent panel. Thus, the total structure is built up by selecting the desired components and combining them to form the desired final configuration. As previously described, window units 28 and smaller wall panels 30 may be substituted for wall members 22 to customize the appearance and function of the structure according to the individual desires of the builder. Likewise, doors may be fitted in the place of wall panels as desired. FIGS. 10 and 11 illustrate the various combination which may be employed to style the structure to the particular desire of the builder. These figures illustrate that numerous combinations of wall panels 22 and 30 and window units 28, may be substituted and interchanged within the same length of wall structure while varying the arrangement of the various units as desired.

The present system is also readily adaptable to impregnating the electrical wiring necessary to provide an electrical system throughout the structure within the wall and other panels. As is illustrated in FIG. 12, each panel through which electrical wire is desired is fitted with a conduit 90 supported between separating strips 64. Suitable wiring 92 is fitted within conduit 90 and terminates in a connecting terminal 94 exteriorly thereof. Similarly, tongue 72 is prewired having a mating terminal 96 for contacting terminal 94 in the wall panel at one end and having a similar fitting at the opposite end. Thus, it can be seen that when an adjoining panel is connected by inserting tongue 72 in groove 70 of the adjacent panel, electrical terminal 96 receives corresponding terminal 94 in the adjacent panel to complete the electrical connection from one panel to the other. FIG. 13 shows a plan view of the electrical terminal 96 where the ground lead is the center terminal **96*a* with the terminals 96*b* and 96*c* being live leads. While a single wiring connection is illustrated in FIGS. 12 and 13**, it will be understood that more complex wiring may be prewired within components of the present structure such that the wiring of the structure is complete by merely assembling the structure as herein above described.

Thus, the present invention is directed to a novel concept for providing low cost but functional and aesthetically pleasing housing structures from modular components which are simply and easily assembled as well as formed. The components are each formed with an interlocking edge and in the preferred embodiment with a tongue and groove butt type joint between corresponding edges of adjacent components. Thus, the entire structure is constructed with butt type joints only, there being no conventional overlapping or angle joints in the structure.

Because of the structure of the joint members used to interconnect the wall, roof and floor members, each joint is removed from the extreme corner position where maximum stress in the structure occurs. Thus, the structure is more structurally sound than those conventional arrangements where the joint is positioned at the immediate extremity of the walls, floors and roof.

Additionally, the structure is so devised that many components are interchangeable thereby reducing the overall cost of the structure both in construction cost and the necessity of maintaining large inventories for any particular construction project. Likewise, the concept readily provides for rearranging of various components according to the desires of the individual builder and according to the size and shape needs of each user.

Although particular embodiments of the invention have been illustrated in the accompanying drawing and described in the foregoing detailed description, it will be understood that the invention is not limited to the embodiments disclosed but is capable of numerous rearrangements, modifications, and substitutions of parts and elements without departing from the scope of the invention. Moreover, while the present disclosure has been directed to the construction of a home or residence, it will be understood that the present invention is readily adaptable to any structure regardless of the intended use thereof.

What is claimed is:

1. A building structure comprising:

side wall members each having a receiving groove around the periphery thereof;

wall joint members having a curved section with a planar portion extending therefrom such that the longitudinal edges of said wall joint members are removed from the curved section thereof, each said joint member having a receiving groove around the perimeter thereof, said receiving groove being shallower than said planar portion such that the innermost portion of said receiving groove is removed from said curved section along the longitudinal edges of said wall joint members;

tongue members for engagement within corresponding grooves in said side wall members and said wall joint members to form an encircling structure of said side wall members interconnected by said wall joint members;

a roof member having a receiving groove around the entire periphery thereof;

roof to wall joint members each having a curved section with planar portions extending therefrom such that the longitudinal edges of said roof to wall joint members are removed from the curved section thereof, each said roof joint member having a receiving groove around the perimeter thereof in said planar portion, said receiving groove being shallower than said planar portion such that the innermost portion of said receiving groove is removed from said curved section along the longitudinal edges of said roof to wall joint members;

tongue members for engagement within corresponding grooves in said roof member and said roof to wall joint members to join said roof member to said roof to wall joint members;

corner members having a curved portion and three planar sections extending therefrom such that the edges of said corner members are removed from the curved portion thereof, said corner members having a receiving groove around the entire periphery thereof, said receiving groove being shallower than said planar portion such that the innermost portion of said receiving groove is removed from said curved portion;

tongue members for engagement within corresponding grooves in said roof to wall joint members and said wall joint members to attach said corner members to corresponding roof to wall joint members and wall joint members;

electrical wiring within said wall members, said wiring terminating at one end in a terminal in said groove around the periphery thereof;

electrical wiring within said wall joint members, said wiring terminating at one end in a terminal in said groove around the periphery thereof; and electrical wiring positioned within said tongue members, said wiring terminating at the edges of said tongue members at points corresponding to the terminals of said wall members and wall joint members for connecting the wiring between said wall members through said wall joint members such that an electrical wiring circuit is provided from one wall member to another upon assemblage of the wall members and wall joint members.

2. A building structure comprising:

side wall members each having a receiving groove around the periphery thereof;

wall joint members having a curved section with a planar portion extending therefrom such that the longitudinal edges of said wall joint members are removed from the curved section thereof, each said joint member having a receiving groove around the perimeter thereof, said receiving groove being shallower than said planar portion such that the innermost portion of said receiving groove is removed from said curved section along the longitudinal edges of said wall joint members;

tongue members for engagement within corresponding grooves in said side wall members and said wall joint members to form an encircling structure of said side wall members interconnected by said wall joint members;

a roof member having a receiving groove around the entire periphery thereof;

roof to wall joint members each having a curved section with planar portions extending therefrom such that the longitudinal edges of said roof to wall joint members are removed from the curved section thereof, each said roof to wall joint member having a receiving groove around the perimeter thereof, said receiving groove being shallower than said planar portion such that the innermost portion of said receiving groove is removed from said curved section along the longitudinal edges of said roof to wall joint members;

tongue members for engagement within corresponding grooves in said roof member and said roof to wall joint members to join said roof member to said roof to wall joint members;

corner members having a curved portion and three planar sections extending therefrom such that the edges of said corner members are removed from the curved portion thereof, said corner members having a receiving groove around the entire periphery thereof, said receiving groove being shallower than said planar portion such that the innermost portion of said receiving groove is removed from said curved portion;

tongue members for engagement within corresponding grooves in said roof to wall joint members and said wall joint members to attach said corner members to corresponding roof to wall joint members and wall joint members;

a floor member having a receiving groove around the entire perimeter thereof;

floor to wall joint members each having a curved section with planar portions extending therefrom such that the longitudinal edges of said floor to wall joint members are removed from the curved section thereof, said floor to wall joint members having a receiving groove around the entire perimeter thereof, said receiving groove being shallower than said planar portion such that the innermost portion of said receiving groove is removed from said curved section along the longitudinal edges of said floor to wall joint members;

tongue members for engagement within corresponding grooves in said floor member and said floor to wall joint members to attach said floor member to said floor to wall joint members; and tongue members for engagement within corresponding grooves in said floor to wall joint members and said wall joint members to attach said corner members to corresponding floor to wall joint members and wall joint members.

3. The building structure of claim 2 wherein said side wall joint members, said floor to wall joint members and said roof to wall joint members are identical one to the other and thereby interchangeable.

4. The building structure of claim 2 wherein said corner members are identical one to the other and interchangeable.

5. The building structure of claim 2 wherein said floor member is characterized by a plurality of interlocking floor panels, said roof member is characterized by a plurality of interlocking roof panels, and said side wall members are characterized by a plurality of interlocking side wall panels, said floor panels, roof panels and side wall panels being identical one to the other and interchangeable.

6. The building structure of claim 2 wherein said side wall panels may selectively be window units characterized by a transparent sheet surrounded by frame structure having an interlockable edge thereabout for interconnecting the window unit to adjacent structures.

7. The building structure of claim 2 wherein said roof member is characterized by a first series of roof panels interconnected one to the other and joined to a second series of roof panels joined one to the other by a curved ridge joint member having a curved section and planar sections extending therefrom such that the longitudinal edges of said ridge joint member are removed from the curved section, said ridge joint member having a receiving groove around the entire periphery thereof in said planar portion, said receiving groove being shallower than said planar section such that the innermost portion of said receiving groove is removed from said curved section along the longitudinal edges.

8. The building structure of claim 7 and further characterized by:

triangular gable panels having a receiving groove around the periphery thereof;

roof to gable joint members having a curved section with a planar portion extending therefrom such that the longitudinal edges of said wall joint members are removed from the curved section thereof, each said joint member having a receiving groove around the periphery thereof, said receiving groove being shallower than said planar portion such that the innermost portion of said receiving groove is removed from said curved section along the longitudinal edges of said roof to gable joint members; and tongue members for engagement in the corresponding grooves in said triangular gable panels and said roof to gable joint members and said wall members to join the gable panels to said roof member and said wall members.

9. A building structure comprising:

side wall members each having an inner and outer skin separated by separating strips positioned parallel to and removed inwardly from the edges of said inner and outer skin to form a receiving groove around the periphery thereof;

wall joint members having an inner and outer skin separated by separating strips positioned inwardly from the edges of said inner and outer skin, said wall joint members having a curved section with a planar portion extending therefrom, each said joint member having a receiving groove between the inner and outer skin around the perimeter thereof, said receiving groove being shorter than said planar portion such that the innermost portion of said receiving groove defined by the outermost surface of said separating strips is removed from said curved section along the edge of said planar portions remote from said curved section;

tongue members for engagement within corresponding grooves in said side wall members and said wall joint members to form an encircling structure of said side wall members interconnected by said wall joint members;

a roof member having an inner and outer skin separated by separating strips positioned inwardly from the edges of said inner and outer skin to form a receiving groove around the periphery thereof;

roof to wall joint members each having an inner and outer skin separated by separating strips positioned inwardly from the edges of said inner and outer skin, said roof to wall joint members having a curved section with planar portions extending therefrom, each said roof joint member having a receiving groove between the inner and outer skin around the perimeter thereof, said receiving groove being shorter than said planar portion such that the innermost portion of said receiving groove defined by the outermost surface of said separating strips is removed from said curved section along the edge of said planar portions remote from said curved section;

tongue members for engagement within corresponding grooves in said roof member and said roof to wall joint members to join said roof member to said roof to wall joint members;

corner members having an inner and outer skin separated by separating strips positioned inwardly from the edges of said inner and outer skin, said corner members having a curved portion and three planar sections extending therefrom, said corner members having a receiving groove between said inner and outer skin around the periphery thereof, said receiving groove being shorter than said planar portion such that the innermost portion of said receiving groove defined by the outermost surface of said separating strips is removed from said curved section; and tongue members for engagement within corresponding grooves in said roof to wall joint members and said wall joint members to attach said corner members to adjacent roof to wall joint members and wall joint members.

10. The building structure of claim 9 further comprising: a floor member having an inner and outer skin separated by separating strips positioned inwardly from the edges of said inner and outer skin to form a receiving groove around the perimeter thereof;

floor to wall joint members each having an inner and outer skin separated by separating strips positioned inwardly from the edges of said inner and outer skin, said floor to wall joint members having a curved section with planar portions extending therefrom, said floor to wall joint members having a receiving groove between the inner and outer skin around the perimeter thereof such that the innermost portion of said receiving groove defined by the outermost surface of said separating strips is removed from said curved section along the edge of said planar portions remote from said curved section;

tongue members for engagement within corresponding grooves in said floor members and said floor to wall joint members to attach said floor member to said floor to wall joint members; and tongue members for engagement within corresponding grooves in said floor to wall joint members and said wall joint members to attach said corner members to corresponding floor to wall joint members and wall joint members.

11. The building structure of claim 9 wherein said side wall joint members, said floor to wall joint members and said roof to wall joint members are identical one to the other and thereby interchangeable.

12. The building structure of claim 9 wherein said corner members are identical one to the other and interchangeable.

* * * * *